US009554215B2

(12) United States Patent
Wei et al.

(10) Patent No.: US 9,554,215 B2
(45) **Date of Patent: *Jan. 24, 2017**

(54) EARPHONE

(71) Applicants: Tsinghua University, Beijing (CN); HON HAI PRECISION INDUSTRY CO., LTD., New Taipei (TW)

(72) Inventors: Yang Wei, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/696,927

(22) Filed: Apr. 27, 2015

(65) Prior Publication Data

US 2015/0319539 A1 Nov. 5, 2015

(30) Foreign Application Priority Data

Apr. 30, 2014 (CN) ..... 2014 1 0179640

(51) Int. Cl.

| | |
|---|---|
| ***H04R 1/10*** | (2006.01) |
| ***H04R 23/00*** | (2006.01) |
| *H04R 25/00* | (2006.01) |
| *H04R 1/24* | (2006.01) |
| *H04R 1/26* | (2006.01) |

(52) U.S. Cl.

CPC ..... *H04R 23/002* (2013.01); *H04R 1/1091* (2013.01); *H04R 1/24* (2013.01); *H04R 1/26* (2013.01)

(58) Field of Classification Search

CPC . H04R 2205/022; H04R 5/033; H04R 23/002; H04R 1/1075; H04R 1/24

USPC ..... 381/370, 164, 182, 74

See application file for complete search history.

(56) References Cited

U.S. PATENT DOCUMENTS

| | | | | |
|---|---|---|---|---|
| 6,263,085 | B1 * | 7/2001 | Weffer | H04R 5/033 379/430 |
| 6,356,644 | B1 * | 3/2002 | Pollak | H04R 1/1008 181/129 |
| 8,135,158 | B2 | 3/2012 | Fincham | |
| 2010/0086166 | A1 * | 4/2010 | Jiang | H04R 23/002 381/380 |
| 2010/0166232 | A1 * | 7/2010 | Liu | H04R 1/028 381/164 |
| 2011/0051961 | A1 | 3/2011 | Jiang et al. | |

FOREIGN PATENT DOCUMENTS

| | | |
|---|---|---|
| TW | 200838347 | 9/2008 |
| TW | M469710 | 1/2014 |

* cited by examiner

*Primary Examiner* — Sunita Joshi
(74) *Attorney, Agent, or Firm* — Zhigang Ma

(57) ABSTRACT

The disclosure relates to an earphone. The earphone includes a housing, a first speaker located in the housing and configured to play a first sound in a high frequency range, and a second speaker located in the housing and configured to play a second sound in a low frequency range or a middle frequency range. The first speaker includes a thermoacoustic device unit including a sound wave generator including carbon nanotube structure. The second speaker is an electric loudspeaker, electromagnetic speaker, or capacitive speaker.

19 Claims, 13 Drawing Sheets

EARPHONE

CROSS-REFERENCE TO RELATED APPLICATIONS

This application claims priority to Chinese Patent Application No. 201410179640.3 filed on Apr. 30, 2014 in the China Intellectual Property Office, the contents of which are incorporated by reference herein.

FIELD

The subject matter herein generally relates to earphones and, particularly, to a carbon nanotube based earphone.

BACKGROUND

In general, the speaker includes different types such as low frequency speakers, middle frequency speakers and high frequency speakers according to the frequency range of the sound. The low frequency speakers can play a sound with frequency below 300 Hz, the middle frequency speakers can play a sound with frequency in a range of 300 Hz-2 KHz, and the high frequency speakers can play a sound with frequency above 2 KHz.

The earphone usually includes a speaker installed in the casing of the earphone. However, the speaker is only a single type of the low frequency speakers, middle frequency speakers and high frequency speakers. Thus, the earphone can only play a single type of the low frequency sound, middle frequency sound and high frequency sound and cannot realize the complementary between the low frequency sound, middle frequency sound and high frequency sound.

What is needed, therefore, is to provide an earphone which can overcome the shortcomings as described above.

BRIEF DESCRIPTION OF THE DRAWINGS

Implementations of the present technology will now be described, by way of example only, with reference to the attached figures, wherein.

DETAILED DESCRIPTION

Figure 1:
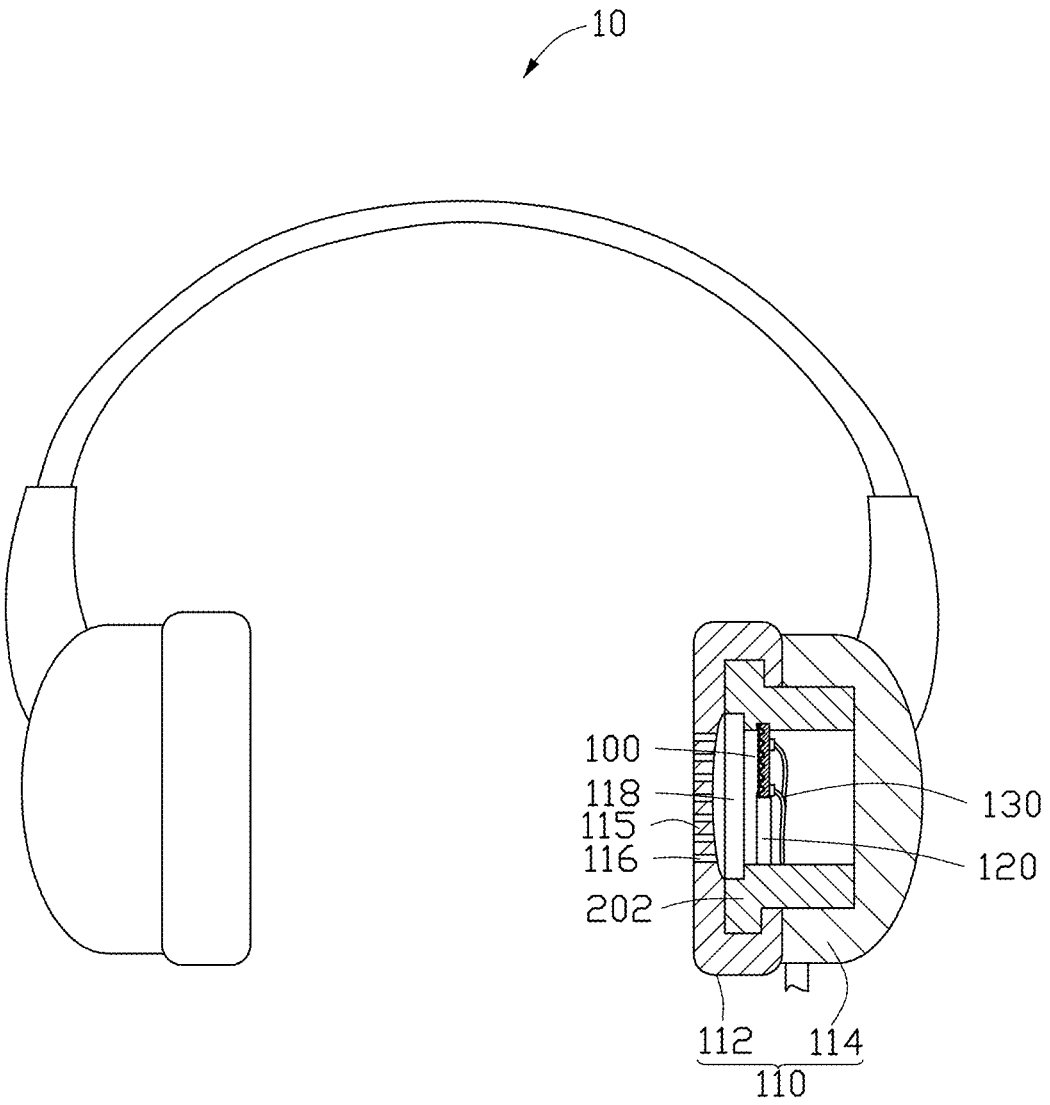
FIG. 1 is a schematic view of one embodiment of an earphone.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like. It should be noted that references to "an" or "one" embodiment in this disclosure are not necessarily to the same embodiment, and such references mean at least one.

FIG. 1 shows one embodiment of an earphone 10. The earphone 10 includes a housing 110, a first speaker 100 and a second speaker 120 located in the housing 110. The housing 110 has a hollow structure. The first speaker 100 and the second speaker 120 are received in the hollow structure and configured to play sound in different frequency ranges.

The housing 110 includes a front shell 112 and a back shell 114. The front shell 112 and the back shell 114 are combined to form the hollow structure by a snap-fit. The front shell 112 includes a sound portion 115. A plurality of through openings 116 are defined in the sound portion 115. The housing 110 further defines a plurality of heat dissipation holes (not shown) on the back shell 114.

The housing 110 can be made of lightweight and strong plastic or resin. The housing 110 covers an ear of user while being used. Furthermore, the earphone 10 includes a protective cover 118 covering the plurality of through openings 116 to protect the speakers 100, 120. The protective cover 118 is located between the sound portion 115 and the speakers 100, 120 and spaced from the speakers 100, 120 and the sound portion 115. A plurality of through holes (not shown) are defined in the protective cover 118. The material of the protective cover 118 can be plastic or metal. The protective cover 118 is optional.

The earphone 10 further includes a plurality of leading wires 130 extending from outside of the housing 110 into inside of the housing 110 and electrically connected to the speakers 100, 120. The plurality of leading wires 130 are used to input audio electrical signals and driving electrical signals into the speakers 100, 120.

The earphone 10 can further include a sponge (not shown) covering the housing 110 to buffer the pressure on the ear. A microphone (not shown) can also be connected to the housing 110 by a leading wire. An electrical connector (not shown) can also be located in the housing 110 to receive wireless audio signals.

The first speaker 100 is configured to play sound in high frequency range, and the second speaker 120 is configured to play sound in low frequency and middle frequency range. The first speaker 100 and the second speaker 120 are opposite to the sound portion 115. The sound generation surface of the first speaker 100 or the second speaker 120 can form an angle with the sound portion 115. The angle is greater than 0 degrees and less than 90 degrees. In one embodiment, the first speaker 100 and the second speaker 120 are fixed on the back shell 114 and spaced from the front shell 112. The sound generation surface of the first speaker 100 and the sound generation surface of the second speaker 120 are coplanar and face the sound portion 115. The first speaker 100 and the second speaker 120 are in direct contact with each other to form an integrated unit to cover the sound portion 115. The sound produced by the first speaker 100 and the second speaker 120 can get out of the housing 110 from the sound portion 115.

The first speaker 100 and the second speaker 120 can be installed on the back shell 114 of the housing 110 and attachable by a fastener. In one embodiment, the first speaker 100 and the second speaker 120 are fixed onto the back shell 114 by a carrier portion 202. The carrier portion 202 can be a bulge structure located on the back shell 114. The carrier portion 202 and the back shell 114 integrity form. Part of the thermoacoustic device unit 100*a* is attached with the carrier portion 202. Part of the first speaker 100 is suspended over the hollow structure to make heat generated by the first speaker 100 dissipate sufficiently.

The material of the carrier portion 202 can be insulating material, such as diamond, glass, ceramic, quartz, plastic or resin. The carrier portion 202 can have a good thermal insulating property, thereby preventing the carrier portion 202 from absorbing the heat generated by the sound wave generator 105.

Figure 2:
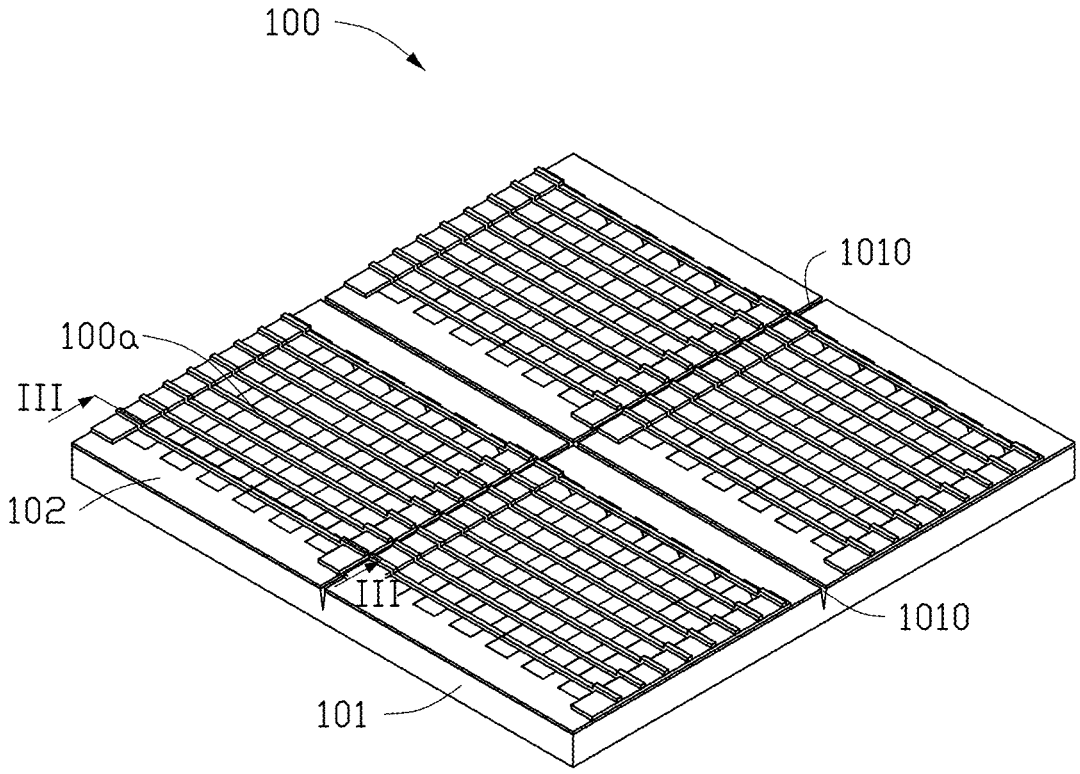
FIG. 2 is an exploded, isometric view of a plurality of first speakers of the earphone of FIG. 1.

Referring to FIG. 2, the first speaker 100 includes a plurality of thermoacoustic device units 100*a*. The plurality of thermoacoustic device units 100*a* can be aggregated together to form a whole structure. The plurality of thermoacoustic device units 100*a* can be located on the same substrate or different substrates. The plurality of thermoacoustic device units 100*a* is arranged symmetrically or asymmetrically in the housing 110. In one embodiment, the plurality of thermoacoustic device units 100*a* are arranged on a substrate 101 to form an array. Adjacent two thermoacoustic device units 100*a* are separated by a plurality of cutting lines 1010 and work independently. The plurality of cutting lines 1010 are located on a first surface 102 of the substrate 101 and defined by the substrate 101. The location of the plurality of cutting lines 1010 are selected according to number of the thermoacoustic device units 100*a* and area of the substrate 101. In one embodiment, each of the plurality of cutting lines 1010 is substantially parallel to or perpendicular to each other. The shape of the cutting lines 1010 can be a through hole, a blind recess (i.e., a depth of the cutting lines 1010 is less than a thickness of the substrate 101), a blind hole. In one embodiment, the shape of the cutting lines 1010 is a through hole to make heat generated by the thermoacoustic device units 100*a* dissipated sufficiently. Number of the thermoacoustic device units 100*a* is selected according to need. In one embodiment, the number of the thermoacoustic device units 100*a* is four.

Figure 3:
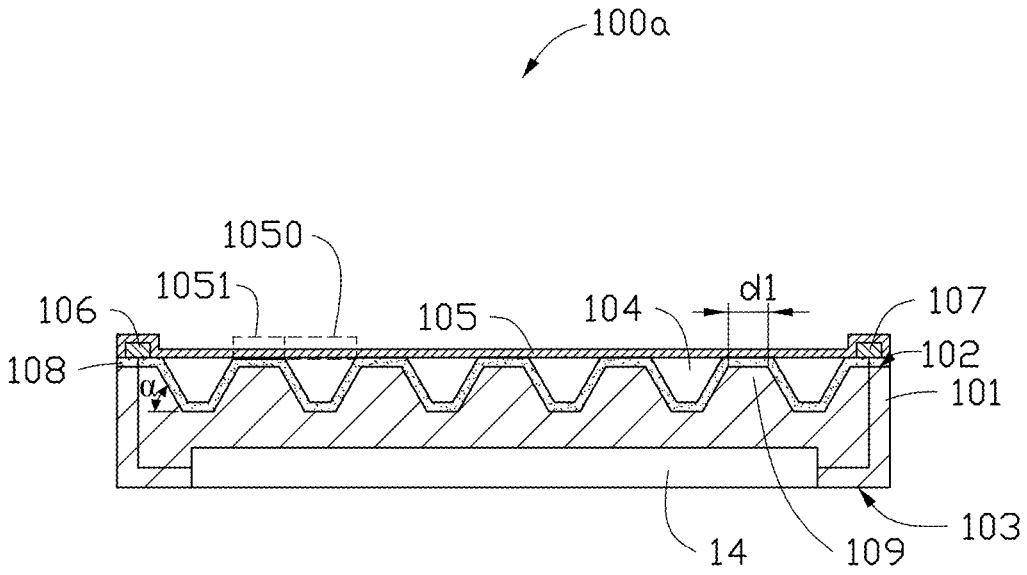
FIG. 3 is a transverse, cross-sectional view of one of the plurality of first speakers of FIG. 2, taken along line III-III.

Referring to FIG. 3, the thermoacoustic device unit 100*a* includes a substrate 101, a sound wave generator 105, a first electrode 106 and a second electrode 107. The substrate 101 includes a first surface 102 and a second surface 103 opposite to the first surface 102. A plurality of recesses 104 are defined by the substrate 101. The plurality of recesses 104 are spaced from each other and located on the first surface 102 of the substrate 101. The sound wave generator 105 is located on the first surface 102 and is suspended over the plurality of recesses 104. The first electrode 106 and the second electrode 107 are spaced from each other. At least one recess 104 is located between the first electrode 106 and the second electrode 107. The first electrode 106 and the second electrode 107 are electrically connected to the sound wave generator 105.

The substrate 101 is sheet-shaped. The shape of the substrate 101 can be circular, square, rectangular or other geometric figure. The first surface 102 of the substrate 101 can be cambered. The resistance of the substrate 101 is greater than the resistance of the sound wave generator 105 to avoid a short through the substrate 101. The substrate 101 can have a good thermal insulating property, thereby preventing the substrate 101 from absorbing the heat generated by the sound wave generator 105. The material of the substrate 101 can be single crystal silicon or multicrystalline silicon. The size of the substrate 101 ranges from about 25 square millimeters to about 100 square millimeters, such as 36 square millimeters, 64 square millimeters or 81 square millimeters. In one embodiment, the substrate 101 is single crystal silicon with a thickness of about 0.6 millimeters, the shape of the substrate 101 is square, and a length of each side of the substrate 101 is about 3.2 centimeters.

The plurality of recesses 104 can be uniformly dispersed on the first surface 102 such as dispersed in an array. The plurality of recesses 104 can also be randomly dispersed. In one embodiment, the plurality of recesses 104 extends along the same direction, and spaced from each other with a certain distance. The shape of the recess 104 can be a through hole, a blind recess (i.e., a depth of the recess 104 is less than a thickness of the substrate 101), or a blind hole. Each of the plurality of recesses 104 includes a bottom and a sidewall adjacent to the bottom. The first portion 1050 is spaced from the bottom and the sidewall. A bulge 109 is formed between the adjacent two recesses 104.

A depth of the recess 104 can range from about 100 micrometers to about 200 micrometers. The sound waves reflected by the bottom surface of the blind recesses may have a superposition with the original sound waves, which may lead to an interference cancellation. To reduce this impact, the depth of the blind recesses that can be less than about 200 micrometers. In another aspect, when the depth of the blind recesses is less than 100 micrometers, the heat generated by the sound wave generator 105 would be dissipated insufficiently. To reduce this impact, the depth of the blind recesses and holes can be greater than 100 micrometers.

The plurality of recesses 104 can parallel with each other and extend along the same direction. A distance d1 between adjacent two recesses 104 can range from about 20 micrometers to about 200 micrometers. Thus the first electrode 106 and the second electrode 107 can be printed on the substrate 101 via nano-imprinting method. A cross section of the recess 104 along the extending direction can be V-shaped, rectangular, or trapezoid. In one embodiment, a width of the recess 104 can range from about 0.2 millimeters to about 1 micrometer. Thus sound wave generator 105 can be prevented from being broken. Furthermore, a driven voltage of the sound wave generator 105 can be reduced to lower than 12V. In one embodiment, the driven voltage of the sound wave generator 105 is lower than or equal to 5V. In one embodiment, the shape of the recess 104 is trapezoid. An angle $\alpha$ is defined between the sidewall and the bottom. The angle $\alpha$ is equal to the crystal plane angle of the substrate 101. In one embodiment, the width of the recess 104 is about 0.6 millimeters, the depth of the recess 104 is about 150 micrometers, the distance d1 between adjacent two recesses 104 is about 100 micrometers, and the angle $\alpha$ is about 54.7 degrees.

The first speaker 100 further includes an insulating layer 108. The insulating layer 108 can be a single-layer structure or a multi-layer structure. In one embodiment, the insulating layer 108 can be merely located on the plurality of bulges 109. In another embodiment, the insulating layer 108 is a continuous structure, and attached on the entire first surface 102. The insulating layer 108 covers the plurality of recesses 104 and the plurality of bulges 109. The sound wave generator 105 is insulated from the substrate 101 by the insulating layer 108. In one embodiment, the insulating layer 108 is a single-layer structure and covers the entire first surface 102.

The material of the insulating layer 108 can be $SiO_2$, $Si_3N_4$, or combination of them. The material of the insulating layer 108 can also be other insulating materials. A thickness of the insulating layer 108 can range from about 10 nanometers to about 2 micrometers, such as 50 nanometers, 90 nanometers, and 1 micrometer. In one embodiment, the thickness of the insulating layer is about 1.2 micrometers.

The sound wave generator 105 is located on the first surface 102 and insulated from the substrate 101 by the insulating layer 108. The sound wave generator 105 defines a first portion 1050 and a second portion 1051. The first portion 1050 is suspended over the plurality of recesses 104, and the second portion 1051 is attached on the plurality of bulges 109. The second portion 1051 can be attached on the plurality of bulges 109 via an adhesive layer or adhesive particles (not shown). The sound wave generators 105 of two adjacent thermoacoustic device units 100*a* are insulated from each other and work individually by receiving different signals.

The sound wave generator 105 has a very small heat capacity per unit area. The heat capacity per unit area of the sound wave generator 105 is less than $2\times10^{-4}$ J/cm$^2$*K. The sound wave generator 105 can be a conductive structure with a small heat capacity per unit area and a small thickness. The sound wave generator 105 can have a large specific surface area for causing the pressure oscillation in the surrounding medium by the temperature waves generated by the sound wave generator 105. The sound wave generator 105 can be a free-standing structure. The term "free-standing" includes, but is not limited to, a structure that does not have to be supported by a substrate and can sustain the weight of it when it is hoisted by a portion thereof without any significant damage to its structural integrity. The suspended part of the sound wave generator 105 will have more sufficient contact with the surrounding medium (e.g., air) to have heat exchange with the surrounding medium from both sides of the sound wave generator 105. The sound wave generator 105 is a thermoacoustic film.

The sound wave generator 105 can be or include a free-standing carbon nanotube structure. The carbon nanotube structure may have a film structure. The thickness of the carbon nanotube structure may range from about 0.5 nanometers to about 1 millimeter. The carbon nanotubes in the carbon nanotube structure are combined by van der Waals attractive force therebetween. The carbon nanotube structure has a large specific surface area (e.g., above 30 m2/g). The larger the specific surface area of the carbon nanotube structure, the smaller the heat capacity per unit area will be. The smaller the heat capacity per unit area, the higher the sound pressure level of the sound produced by the sound wave generator 105.

The carbon nanotube structure can include at least one carbon nanotube film, a plurality of carbon nanotube wires, or a combination of carbon nanotube film and the plurality of carbon nanotube wires.

The carbon nanotube film can be a drawn carbon nanotube film formed by drawing a film from a carbon nanotube array that is capable of having a film drawn therefrom. The heat capacity per unit area of the drawn carbon nanotube film can be less than or equal to about $1.7\times10^{-6}$ J/cm$^2$*K. The drawn carbon nanotube film can have a large specific surface area (e.g., above 100 m2/g). In one embodiment, the drawn carbon nanotube film has a specific surface area in the range from about 200 m$^2$/g to about 2600 m$^2$/g. In one embodiment, the drawn carbon nanotube film has a specific weight of about 0.05 g/m$^2$.

The thickness of the drawn carbon nanotube film can be in a range from about 0.5 nanometers to about 100 nanometers. When the thickness of the drawn carbon nanotube film is small enough (e.g., smaller than 10 μm), the drawn carbon nanotube film is substantially transparent.

Figure 4:
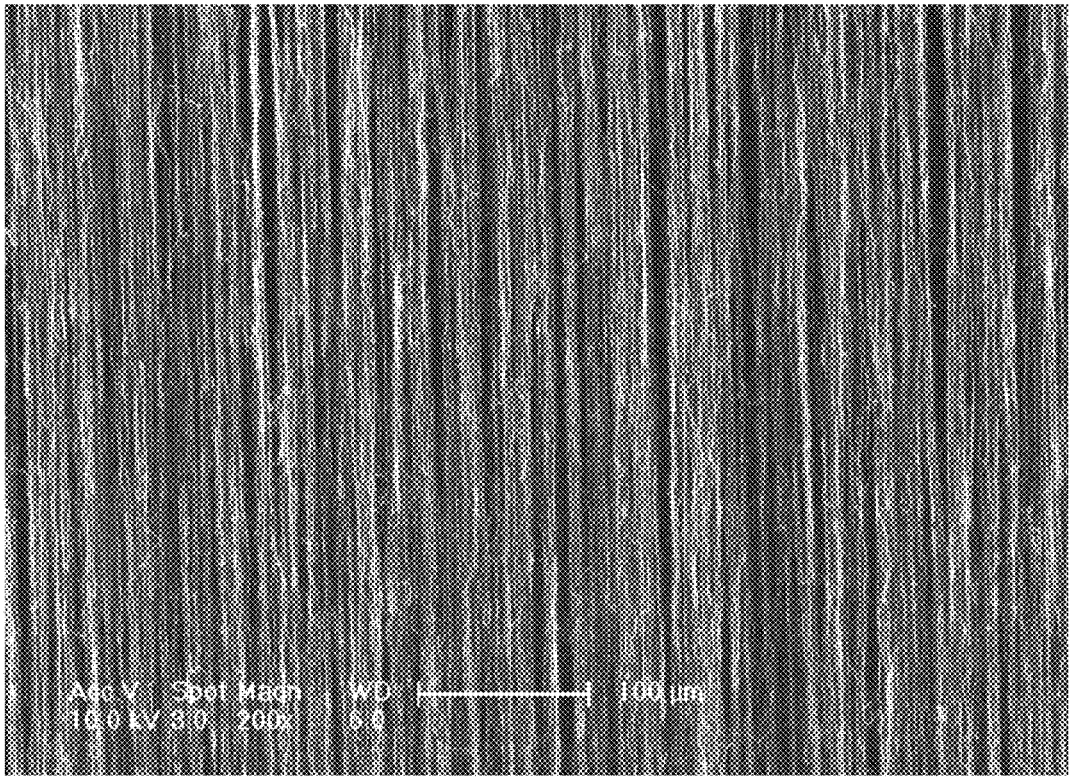
FIG. 4 shows a scanning electron microscope (SEM) image of an embodiment carbon nanotube film in the thermoacoustic device unit.

Referring to FIG. 4, the drawn carbon nanotube film includes a plurality of successive and oriented carbon nanotubes joined end-to-end by van der Waals attractive force therebetween. The carbon nanotubes in the drawn carbon nanotube film can be substantially oriented along a single direction and substantially parallel to the surface of the carbon nanotube film. Furthermore, an angle $\beta$ can exist between the oriented direction of the carbon nanotubes in the drawn carbon nanotube film and the extending direction of the plurality of recesses 104, and $0<\beta90°$. In one embodiment, the oriented direction of the plurality of carbon nanotubes is perpendicular to the extending direction of the plurality of recesses 104. As can be seen in FIG. 4, some variations can occur in the drawn carbon nanotube film. The drawn carbon nanotube film is a free-standing film. The drawn carbon nanotube film can be formed by drawing a film from a carbon nanotube array that is capable of having a carbon nanotube film drawn therefrom. Furthermore, each of the plurality of carbon nanotubes is substantially parallel with the first surface 102.

The carbon nanotube structure can include more than one carbon nanotube films. The carbon nanotube films in the carbon nanotube structure can be coplanar and/or stacked. Coplanar carbon nanotube films can also be stacked one upon other coplanar films. Additionally, an angle can exist between the orientation of carbon nanotubes in adjacent films, stacked and/or coplanar. Adjacent carbon nanotube films can be combined by only the van der Waals attractive force therebetween without the need of an additional adhesive. The number of the layers of the carbon nanotube films is not limited. However, as the stacked number of the carbon nanotube films increases, the specific surface area of the carbon nanotube structure will decrease. A large enough specific surface area (e.g., above 30 $m^2/g$) must be maintained to achieve an acceptable acoustic volume. An angle θ between the aligned directions of the carbon nanotubes in the adjacent two drawn carbon nanotube films can range from about 0 degrees to about 90 degrees. Spaces are defined between adjacent two carbon nanotubes in the drawn carbon nanotube film. When the angle θ between the aligned directions of the carbon nanotubes in adjacent drawn carbon nanotube films is larger than 0 degrees, a microporous structure is defined by the carbon nanotubes in the sound wave generator 105. The carbon nanotube structure in an embodiment employing these films will have a plurality of micropores. Stacking the carbon nanotube films will add to the structural integrity of the carbon nanotube structure.

Each of the plurality of carbon nanotube wires is parallel with and spaced from each other. The plurality of carbon nanotube wires is intersected with the plurality of recesses 104. In one embodiment, the plurality of carbon nanotube wires is perpendicular to the plurality of recesses 104. Each of the plurality of carbon nanotube wires includes a plurality of carbon nanotubes, and the extending direction of the plurality of carbon nanotubes is parallel with the carbon nanotube wire. The plurality of carbon nanotube wires is suspended over the plurality of recesses 104.

A distance between adjacent two carbon nanotube wires ranges from about 1 micrometers to about 200 micrometers, such as 50 micrometers, 150 micrometers. In one embodiment, the distance between adjacent tow carbon nanotube wires is about 120 micrometers. A diameter of the carbon nanotube wire ranges from about 0.5 nanometers to about 100 micrometers. In one embodiment, the distance between adjacent two carbon nanotube wires is about 120 micrometers, and the diameter of the carbon nanotube wire is about 1 micrometer.

Figure 5:
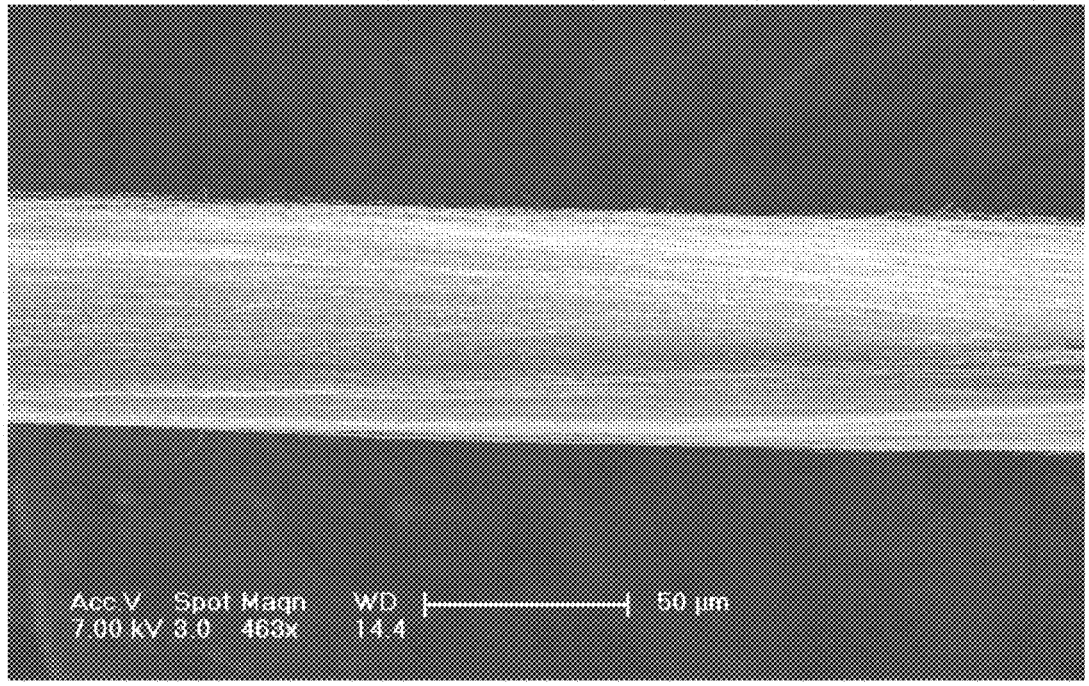
FIG. 5 shows an SEM image of an embodiment untwisted carbon nanotube wire.

The carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. Referring to FIG. 5, the untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. More specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity and shape. Length of the untwisted carbon nanotube wire can be arbitrarily set as desired. A diameter of the untwisted carbon nanotube wire ranges from about 0.5 nanometers to about 100 micrometers.

Figure 6:
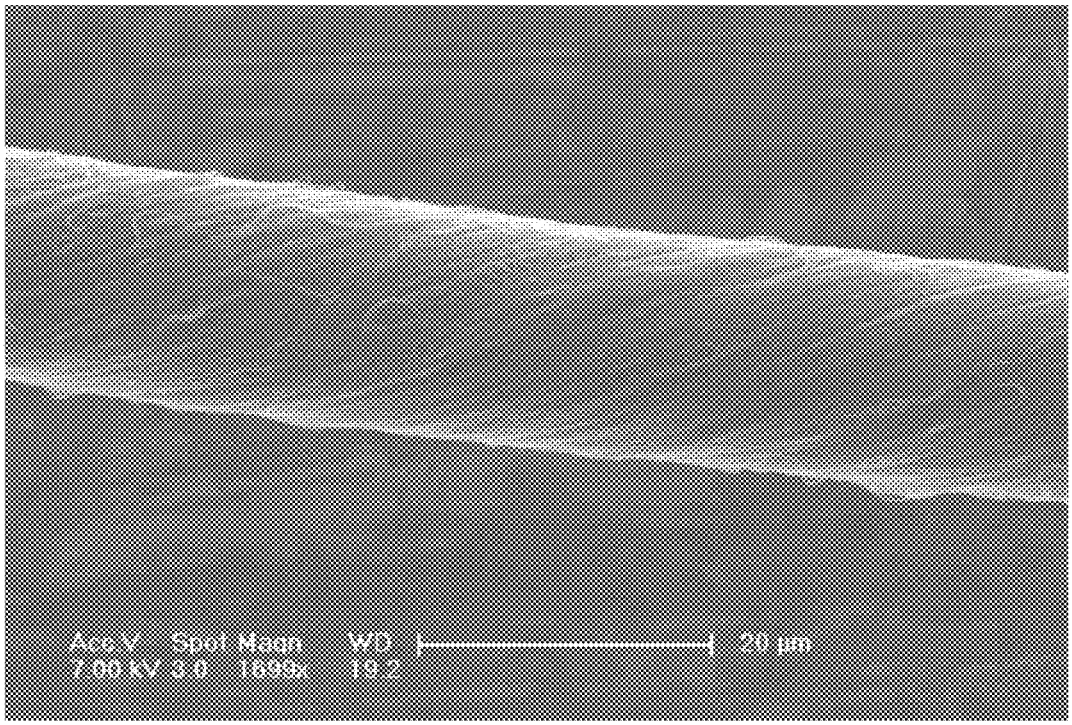
FIG. 6 shows an SEM image of an embodiment twisted carbon nanotube wire.

The twisted carbon nanotube wire can be formed by twisting a drawn carbon nanotube film using a mechanical force to turn the two ends of the drawn carbon nanotube film in opposite directions. Referring to FIG. 6, the twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals attractive force therebetween. Each carbon nanotube segment includes a plurality of carbon nanotubes parallel to each other, and combined by van der Waals attractive force therebetween. Length of the carbon nanotube wire can be set as desired. A diameter of the twisted carbon nanotube wire can be from about 0.5 nm to about 100 μm. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease, while the density and strength of the twisted carbon nanotube wire will be increased. The deformation of the sound wave generator 105 can be avoided during working, and the distortion degree of the sound wave can be reduced.

In some embodiments, the sound wave generator 105 is a single drawn carbon nanotube film drawn from the carbon nanotube array. The drawn carbon nanotube film has a thickness of about 50 nanometers, and has a transmittance of visible lights in a range from 67% to 95%.

In other embodiments, the sound wave generator 105 can be or include a free-standing carbon nanotube composite structure. The carbon nanotube composite structure can be formed by depositing at least a conductive layer on the outer surface of the individual carbon nanotubes in the above-described carbon nanotube structure. The carbon nanotubes can be individually coated or partially covered with conductive material. Thereby, the carbon nanotube composite structure can inherit the properties of the carbon nanotube structure such as the large specific surface area, the high transparency, the small heat capacity per unit area. Further, the conductivity of the carbon nanotube composite structure is greater than the pure carbon nanotube structure. Thereby, the driven voltage of the sound wave generator 105 using a coated carbon nanotube composite structure will be decreased. The conductive material can be placed on the carbon nanotubes by using a method of vacuum evaporation, spattering, chemical vapor deposition (CVD), electroplating, or electroless plating.

Figure 7:
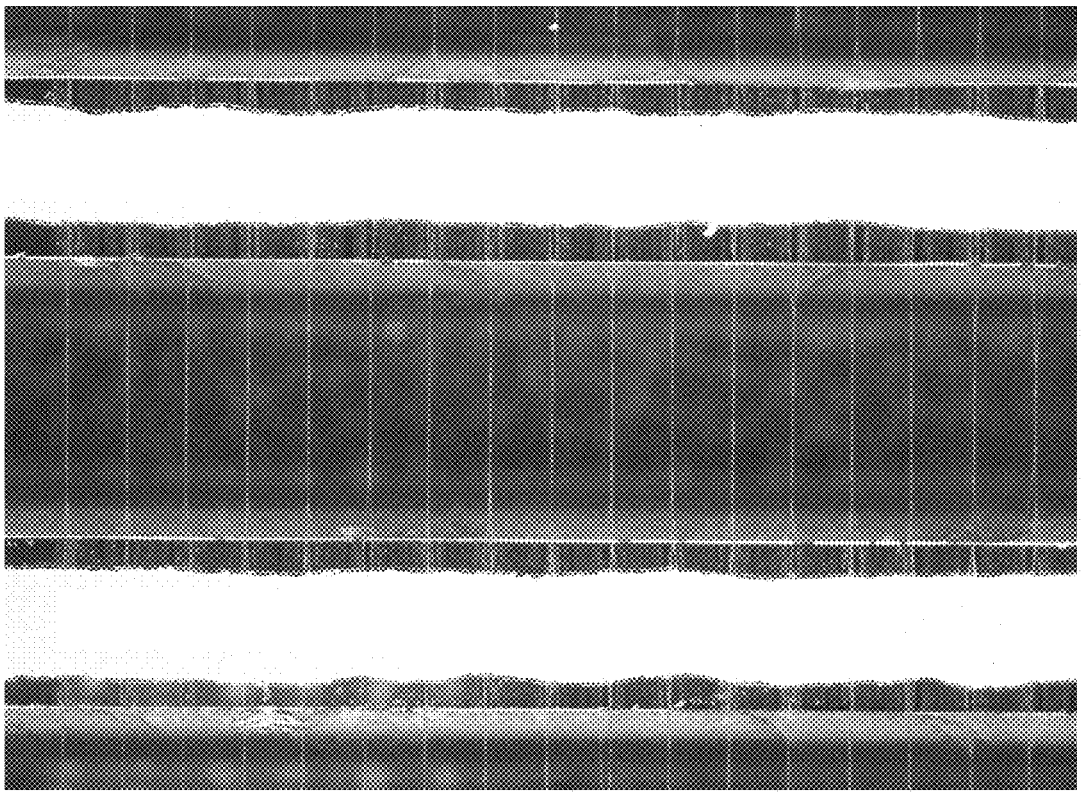
FIG. 7 shows a photomicrograph of an embodiment carbon nanotube wire soaked by an organic solution.

In one embodiment, a laser beam separates the carbon nanotube film of each of the thermoacoustic device units 100*a*. After being separated, the carbon nanotube film is further treated. The carbon nanotube film can be treated by following substeps: forming a plurality of carbon nanotube belts by cutting the carbon nanotube film; and shrinking the plurality of carbon nanotube belts. The carbon nanotube film can be cut with a laser device. During the process of cutting the carbon nanotube film, a plurality of carbon nanotube belts is formed. The plurality of carbon nanotube belts can be shrunk by dipping organic solvent. Referring to FIG. 7, the plurality of carbon nanotube belts is shrunk to form the plurality of carbon nanotube wires. In FIG. 7, the dark portion is the substrate 101, and the white portions are the first electrode 106 and the second electrode 107. The two opposite ends of the plurality of carbon nanotube wires are electrically connected to the first electrode 106 and the second electrode 107. After treating the carbon nanotube film, the driven voltage between the first electrode 106 and the second electrode 107 can be reduced. Furthermore, after being shrunk, this part of the plurality of carbon nanotube wires can be firmly fixed on the bulges 109, and electrically connected to the first electrode 106 and the second electrode 107.

In one embodiment, the sound wave generator 105 includes a plurality of untwisted carbon nanotube wires. The plurality of untwisted carbon nanotube wires is obtained by treating a single drawn carbon nanotube film with an organic solvent. The single drawn carbon nanotube film has a thickness of 50 nanometers. The plurality of untwisted carbon nanotube wires includes a first portion 1050 and a second portion 1051. The first portion 1050 is suspended over the plurality of the recesses 104. The second portion 1051 is attached the bulges 109.

The first electrode 106 and the second electrode 107 are in electrical contact with the sound wave generator 105, and input electrical signals into the sound wave generator 105.

The first electrode 106 and the second electrode 107 are made of conductive material. The shape of the first electrode 106 or the second electrode 107 is not limited and can be lamellar, rod, wire, and block among other shapes. A material of the first electrode 106 or the second electrode 107 can be metals, conductive adhesives, carbon nanotubes, and indium tin oxides among other conductive materials. The first electrode 106 and the second electrode 107 can be metal wire or conductive material layers, such as metal layers formed by a sputtering method, or conductive paste layers formed by a method of screen-printing.

The first electrode 106 and the second electrode 107 can be electrically connected to two terminals of an electrical signal input device (such as a MP3 player) by a conductive wire. Thereby, electrical signals output from the electrical signal device can be input into the sound wave generator 105 through the first electrodes 106, and the second electrodes 107.

The sound wave generator 105 is driven by electrical signals and converts the electrical signals into heat energy. The heat capacity per unit area of the carbon nanotube structure is extremely small, and thus, the temperature of the carbon nanotube structure can change rapidly. Thermal waves, which are propagated into surrounding medium, are obtained. Therefore, the surrounding medium, such as ambient air, can be heated at a frequency. The thermal waves produce pressure waves in the surrounding medium, resulting in sound wave generation. The term "surrounding medium" means the medium outside of the sound wave generator 105, and does not include the medium inside the sound wave generator 105. If the sound wave generator 105 includes carbon nanotubes, the "surrounding medium" does not include the medium inside each carbon nanotube. In this process, it is the thermal expansion and contraction of the medium in the vicinity of the sound wave generator 105 that produces sound. The operating principle of the sound wave generator 105 is "electrical-thermal-sound" conversion.

Figure 8:
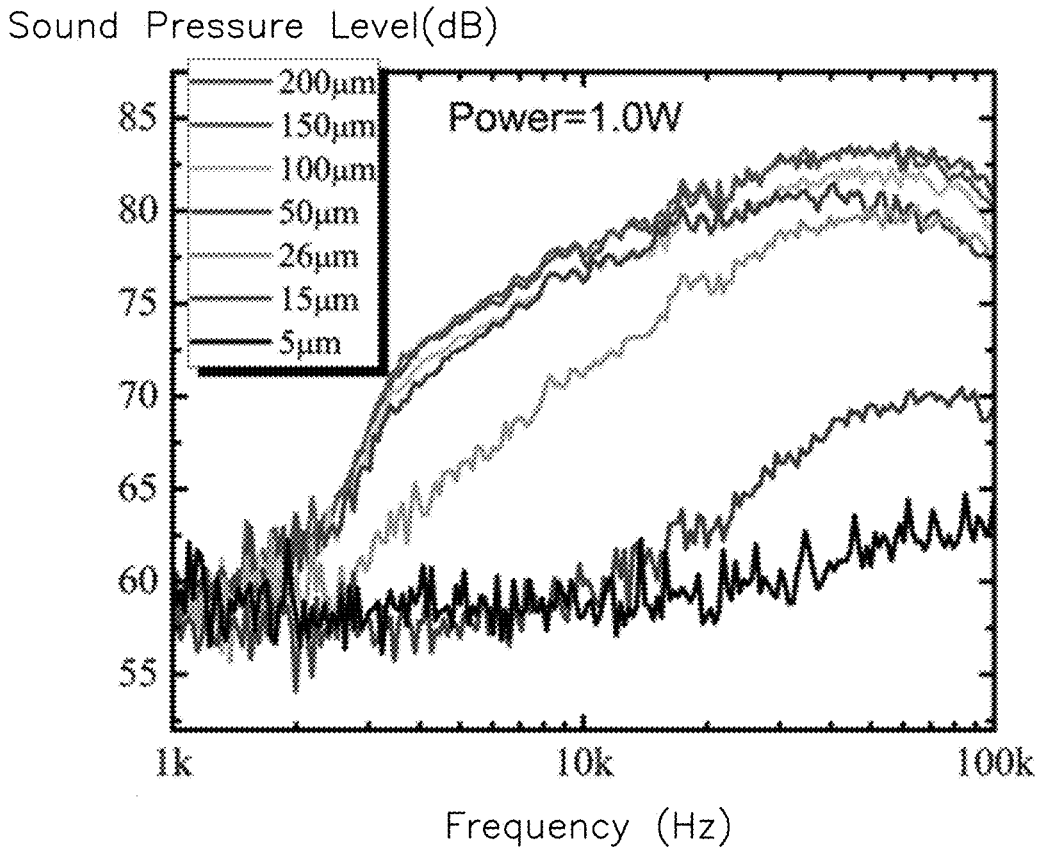
FIG. 8 shows a schematic view of the acoustic effect of an embodiment thermoacoustic device unit of a first speaker.
Figure 9:
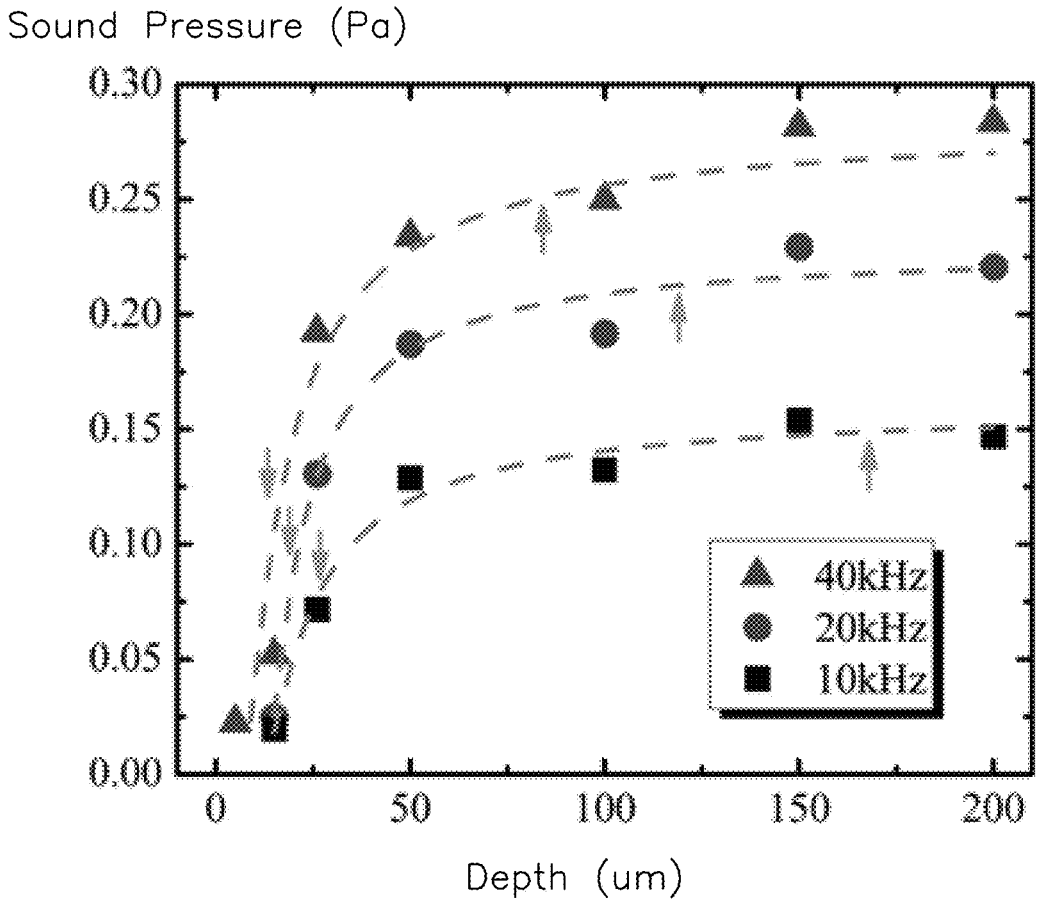
FIG. 9 shows a sound pressure level-frequency curve of an embodiment thermoacoustic device unit of the first speaker.

Referring to FIGS. 8-9, the sound effect of the thermoacoustic device unit 100*a* is related to the depth of the plurality of recesses 104. In one embodiment, the depth of the plurality of recesses 104 ranges from about 100 micrometers to about 200 micrometers. Thus, in the frequency band for which the human can hear, thermoacoustic device unit 100*a* have excellent thermal wavelength. Therefore, the thermoacoustic device unit 100*a* still has good sound effects despite its small size.

Figure 10:
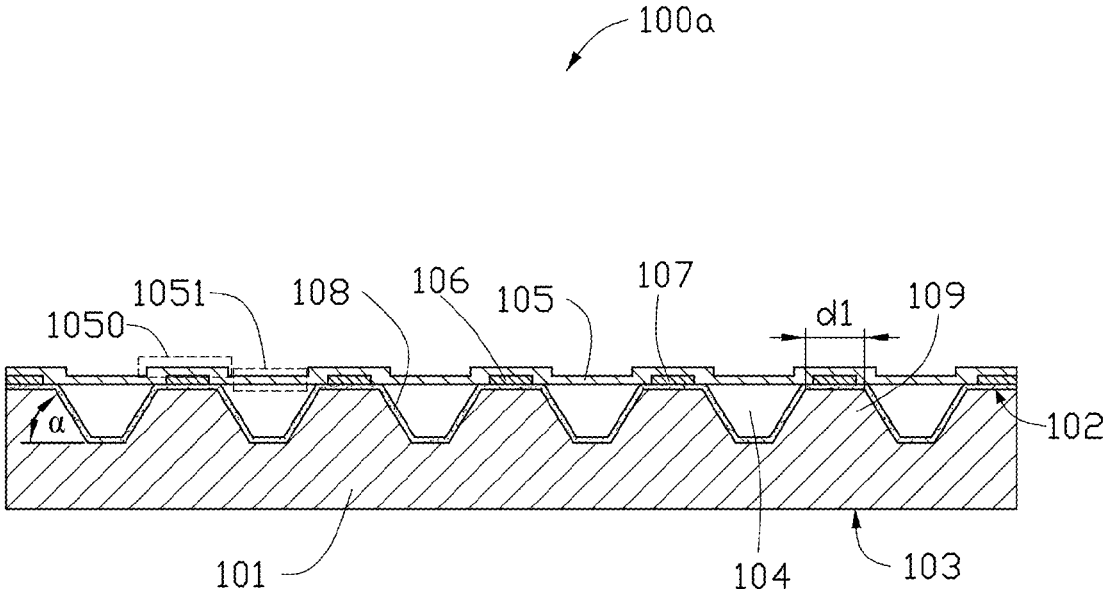
FIG. 10 is a schematic view of one embodiment of a thermoacoustic device unit of a first speaker.

Referring to FIG. 10, in another embodiment, the thermoacoustic device unit 100*a* can also includes a plurality of first electrodes 106 and a plurality of second electrodes 107. The plurality of first electrodes 106 and the plurality of second electrodes 107 can be arranged as a staggered manner of "a-b-a-b-a-b . . . ". All the plurality of first electrodes 106 is electrically connected together and all the plurality of second electrodes 107 is electrically connected together, whereby the sections of the sound wave generator 105 between the adjacent first electrode 106 and the second electrode 107 are in parallel. An electrical signal is conducted in the sound wave generator 105 from the plurality of first electrodes 106 to the plurality of second electrodes 107. By placing the sections in parallel, the resistance of the thermoacoustic device unit is decreased. Therefore, the driving voltage of the thermoacoustic device unit can be decreased with the same effect.

The plurality of first electrodes 106 and the plurality of second electrodes 107 can be substantially parallel to each other with a same distance between the adjacent first electrode 106 and the second electrode 107. The plurality of first electrodes 106 and the plurality of second electrodes 107 are alternatively located on the plurality of bulges 109. The sound wave generator 105 between adjacent first electrodes 106 and the second electrodes 107 is suspended over the plurality of recesses 104.

To connect all the plurality of first electrodes 106 together, and connect all the plurality of second electrodes 107 together, first conducting member and second conducting member can be arranged. All the plurality of first electrodes 106 are connected to the first conducting member. All the plurality of second electrodes 107 are connected to the second conducting member. The sound wave generator 105 is divided by the plurality of first electrodes 106 and the plurality of second electrodes 107 into many sections. The sections of the sound wave generator 105 between the adjacent first electrode 106 and the second electrode 107 are in parallel. An electrical signal is conducted in the sound wave generator 105 from the plurality of first electrodes 106 to the plurality of second electrodes 107.

Figure 11:
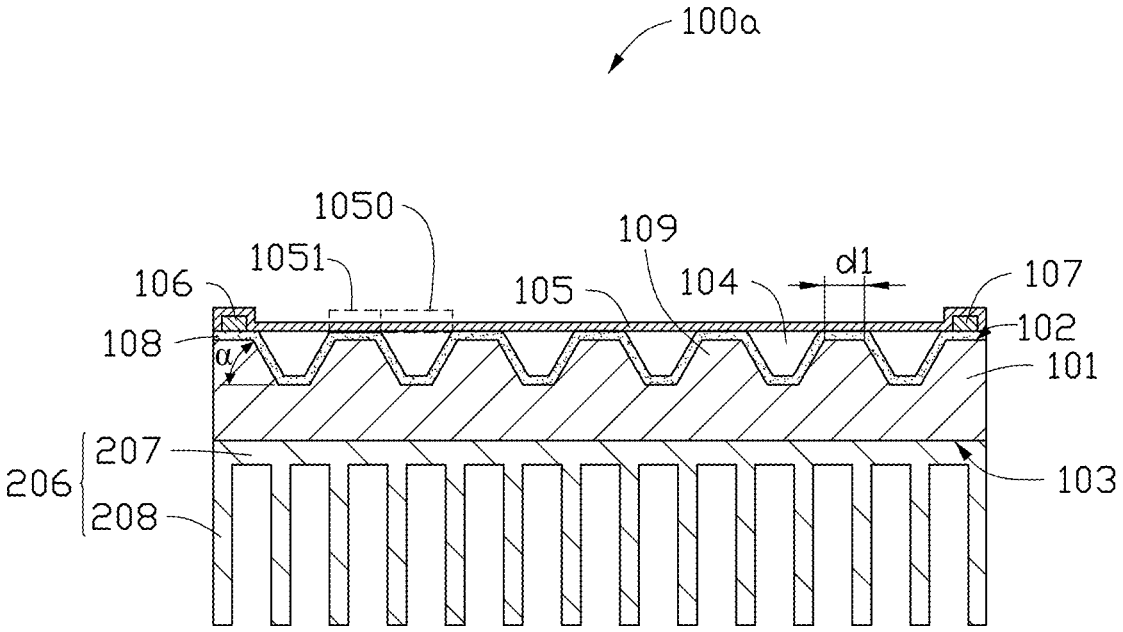
FIG. 11 is a schematic view of one embodiment of a thermoacoustic device unit of a first speaker.

Referring to FIG. 11, in another embodiment, the thermoacoustic device unit 100*a* can also include a heat-sink element 206 on the second surface 103. The heat-sink element 206 is fixed on the second surface 103 by a binder or other carrier element. The heat-sink element 206 includes a base 207 and a plurality of fins 208 located on a surface of the base 207. The base 207 is sheet-shaped. The plurality of fins 208 is fixed on the surface of the base 207 by a binder, a bolt, or a welded joint. The material of the plurality of fins 208 is metal, such as gold, silver, copper, iron, aluminum or a combination thereof. In one embodiment, the plurality of fins 208 is copper sheet with a thickness in a range of about 0.5 millimeters to 1 millimeter. The heat-sink element 206 makes the heat dissipated sufficiently.

Figure 12:
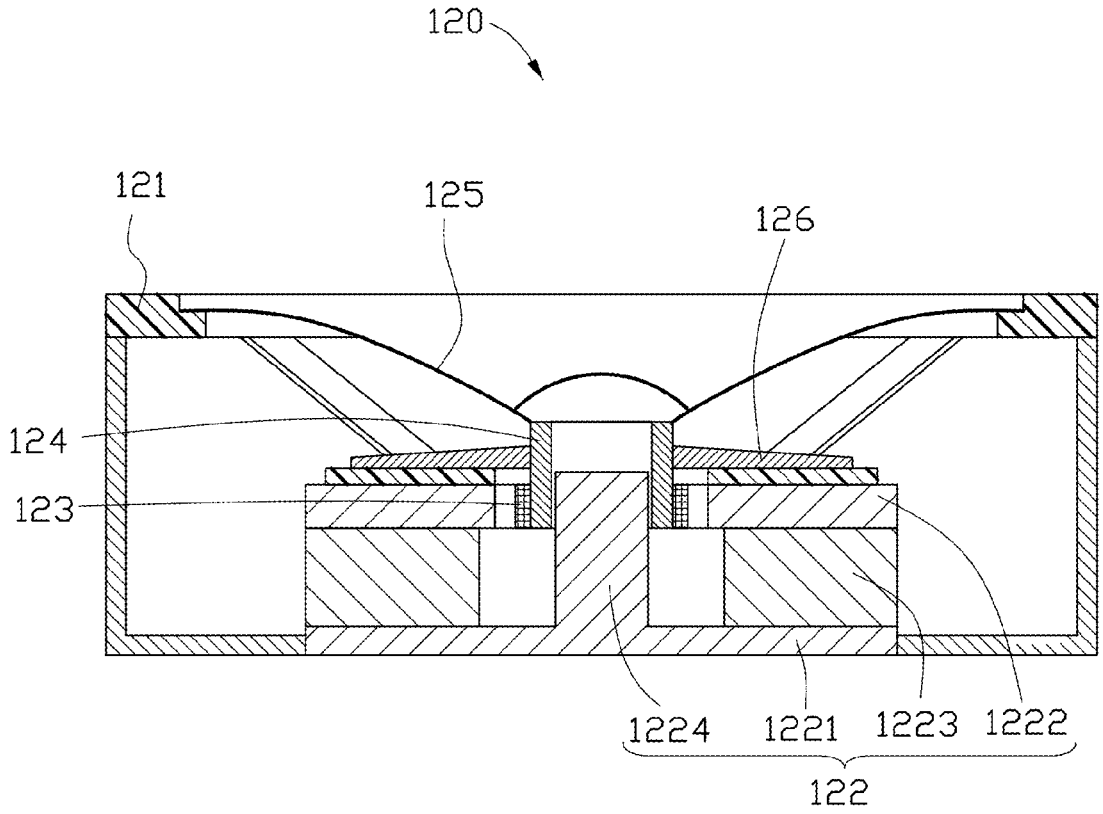
FIG. 12 is a schematic view of one embodiment of a second speaker of the earphone.

The second speaker 120 can be any type of speaker such as an electric loudspeaker, electromagnetic speaker, or capacitive speaker. Referring to FIG. 12, in one embodiment, the second speaker 120 includes a frame 121, a magnetic circuit 122, a voice coil 123, a damper 126, a diaphragm 125, and a bobbin 124.

The frame 121 is mounted on an upper side of the magnetic circuit 122. The voice coil 123 is received in the magnetic circuit 122 and wound on the bobbin 124. An outer rim of the diaphragm 125 is fixed to an inner rim of the frame 121, and an inner rim of the diaphragm 125 is fixed to an outer rim of the bobbin 124 placed in a magnetic gap of the magnetic circuit 122.

The frame 121 is a truncated cone with an opening on one end and includes a hollow cavity and a bottom 113. The hollow cavity receives the diaphragm 125 and the damper 126. The bottom 113 has a center hole 111 to accommodate a center pole 1224 of the magnetic circuit 122. The bottom 113 of the frame 121 is fixed to the magnetic circuit 122.

The magnetic circuit 122 includes a lower plate 1221 having the center pole 1224, an upper plate 1222, and a magnet 1223. The magnet 1223 is sandwiched by the lower plate 1221 and the upper plate 1222. The upper plate 1222 and the magnet 1223 are both circular, and define a cylindrical space in the magnetic circuit 122. The center pole 1224 is received in the space and extends through the center hole 111. The magnetic gap is formed between the center pole 1224 and the magnet 1223. The magnetic circuit 122 is fixed on the bottom 113 at the upper plate 1222.

The voice coil 123 is a driving member of the second speaker 120. The voice coil 123 is made of conducting wire. When electric signals are input to the voice coil 123, a magnetic field is formed by the voice coil 123 that varies with variations in the electric signals. The interaction of the magnetic field of the voice coil 123 and the magnetic circuit 122 induces the voice coil 123 to vibrate.

The bobbin 124 is a hollow cylindrical structure. The center pole 1224 is disposed in the hollow structure and spaced from the damper 126. When the voice coil 123 vibrates, the bobbin 124 and the diaphragm 125 also vibrate with the voice coil 123 to produce pressure waves heard as sound.

The diaphragm 125 has a funnel configuration and is a sound producing member of the second speaker 120. The diaphragm 125 can have a cone shape when used in a large second speaker 120. If the second speaker 120 is small, the diaphragm 125 can have a round or rectangular planar shape.

The damper 126 is a substantially a corrugated round sheet having radial alternating circular ridges and circular furrows. The diaphragm 125 is held mechanically by the damper 126. The damper 126 is fixed to the frame 121 and the bobbin 124. The damper 126 has relatively greater strength in diameter direction, relatively greater elasticity in axial direction, and relatively longer endurance strength. The damper 126 hold the voice coil 123 to freely move up and down but not left and right.

An external input terminal can be attached to the frame 121. A dust cap (not shown) can be fixed over and above a joint portion of the diaphragm 125 and the bobbin 124.

The earphone 10 further includes an integrated circuit (IC) chip 140 electrically connected to the first speaker 100 and the second speaker 120. The first speaker 100 and the second speaker 120 can share the same IC chip 140.

The IC chip 140 can be located on any surface of the substrate 101 or embedded inside the substrate 101. The IC chip 140 can be fixed on the substrate 101 with an adhesive, or installed on the substrate 101 with a fastener. The IC chip 140 includes a power amplification circuit for amplifying audio signal and a direct current (DC) bias circuit. Thus, the IC chip 140 can amplify the audio signal and input the amplified audio signal to the sound wave generator 105. Simultaneously, the IC chip 140 can bias the DC electric signal. The shape and size of the IC chip 140 can be selected according to need. The internal structure of the IC chip 140 is simple because the IC chip 140 only has the functions of power amplification and DC bias. The area of the IC chip 140 is less than 1 square centimeters, such as 49 square millimeters, 25 square millimeters, or 9 square millimeters, to meet the demand for miniaturization.

In one embodiment, the IC chip 140 is a packaged IC chip having a plurality of connectors, such as pins or pads. The IC chip 140 can be installed on the substrate 101 with the plurality of connectors or fixed on the substrate 101 by adhesive. The IC chip 140 is electrically connected to the first electrode 106 and the second electrode 107 via conductive wires (not shown) through holes on the substrate 101. If the substrate 101 is conductive, the conductive wires should be coated with an insulative layer. In operation, the IC chip 140 inputs an audio signal to the sound wave generator 105 and the sound wave generator 105 heats the surrounding medium intermittently according to the input signal to produce a sound by expansion and contraction of the surrounding medium.

As shown in FIG. 3, in one embodiment, the substrate 101 defines a cavity on the second surface 103, and the IC chip 140 is received in the cavity. The material of the substrate 101 can be silicon, thus the IC chip 140 can be directly integrated onto the substrate 101. In one embodiment, the thermoacoustic device units 100*a* further includes a third electrode and a fourth electrode. The third electrode and the fourth electrode are used to apply audio signal from the IC chip 140 into the sound wave generator 105. The third electrode and the fourth electrode are insulated from the substrate 101. The third electrode can be electrically connected to the first electrode 106 and the IC chip 140, and the fourth electrode can be electrically connected to the second electrode 107 and the IC chip 140.

Furthermore, the IC chip 140 can also be located on the first surface 102, thus the third electrode and the fourth electrode can be avoided. The material of the substrate 101 is silicon, thus the IC chip 140 can be directly integrated into the substrate 101, and the thermoacoustic device units 100*a* can be reduced. Furthermore, the substrate 101 has better thermal conductivity, thus the heat can be effectively conducted out of the thermoacoustic device units 100*a*, and distortion of the sound wave can be reduced.

Figure 13:
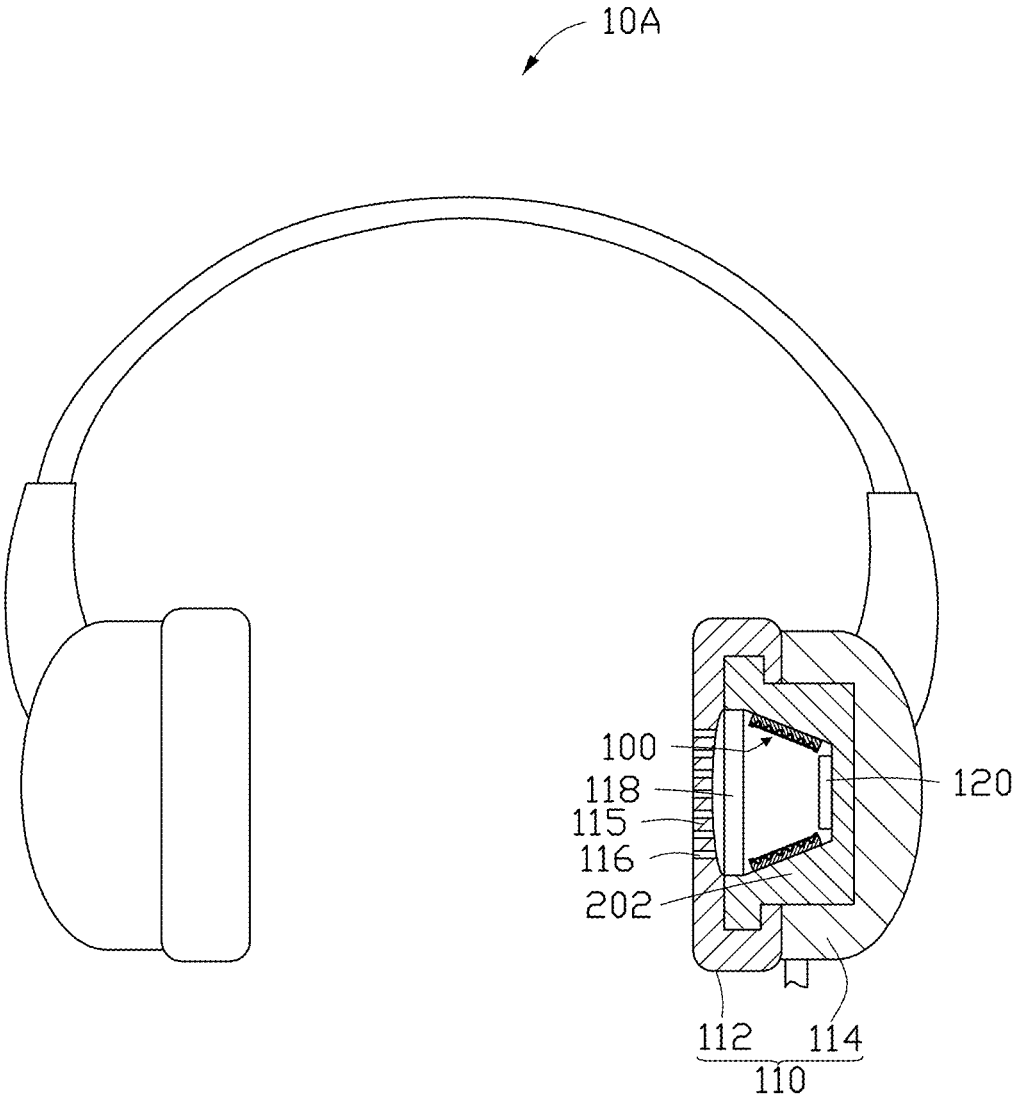
FIG. 13 is a schematic view of one embodiment of an earphone.

FIG. 13 shows another embodiment of an earphone 10A. The earphone 10A includes a housing 110, two first speakers 100 and a second speaker 120 located in the housing 110. The housing 110 has a hollow structure. The first speakers 100 and the second speaker 120 are received in the hollow structure and configured to play sound in different frequency ranges.

The structure of the earphone 10A is similar to that of the earphone 10, except that the earphone 10A includes a single second speaker 120 and two first speakers 100. The second speaker 120 and the two first speakers 100 are not coplanar and fixed in the housing 110 by the carrier portion 202. In one embodiment, the carrier portion 202 defines a recess having a bottom surface facing the sound portion 115 and two side surfaces connecting o the bottom surface. The second speaker 120 is fixed on the bottom surface, and the two first speakers 100 are respectively fixed on the two side surfaces. The angle between one of the two first speakers 100 and the sound portion 115 is different from the angle between the other one of the two first speakers 100 and the sound portion 115. Furthermore, the recess of the carrier portion 202 can have more than two side surfaces, and more than two first speakers 100 are respectively fixed on the side surfaces and form different angles with the sound portion 115. The earphone 10A can play dimensional sound by selecting the first speakers 100 and the second speaker 120.

The embodiments shown and described above are only examples. Even though numerous characteristics and advantages of the present technology have been set forth in the forego description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

Depending on the embodiment, certain of the steps of methods described may be removed, others may be added, and the sequence of steps may be altered. The description and the claims drawn to a method may include some indication in reference to certain steps. However, the indication used is only to be viewed for identification purposes and not as a suggestion as to an order for the steps.

What is claimed is:

1. An earphone, the earphone comprising:

a housing;

a first speaker located in the housing and configured to play a first sound in a high frequency range; and a second speaker located in the housing and configured to play a second sound in a low frequency range or a middle frequency range;

wherein the first speaker comprises a plurality of thermoacoustic device units arranged in an array and each of the plurality of thermoacoustic device units comprises:

a substrate having a first surface and a second surface opposite to the first surface;

a sound wave generator located on the first surface and insulated from the substrate; and a first electrode and a second electrode spaced from each other and electrically connected to the sound wave generator;

wherein the substrate comprises silicon, and the first surface defines a plurality of recesses that are parallel with and spaced from each other, at least one of the plurality of recesses is located between the first electrode and the second electrode, a depth of each of the plurality of recesses ranges from about 100 micrometers to about 200 micrometers, and the sound wave generator comprises a carbon nanotube structure suspended over the at least one of the plurality of recesses.

2. The earphone of claim 1, wherein the housing defines a plurality of through openings, and the first speaker is spaced from and opposite to the plurality of through openings.

3. The earphone of claim 1, wherein the plurality of thermoacoustic device units are located on the same substrate.

4. The earphone of claim 3, wherein adjacent two thermoacoustic device units are insulated from each other.

5. The earphone of claim 3, wherein the substrate further defines a plurality of cutting lines on the first surface, and adjacent two thermoacoustic device units are separated by one of the plurality of cutting lines and work independently.

6. The earphone of claim 1, wherein the plurality of thermoacoustic device units are located on different substrates.

7. The earphone of claim 1, wherein each of the plurality of thermoacoustic device units further comprises an insulating layer located between the first surface of the substrate and the sound wave generator.

8. The earphone of claim 1, wherein the substrate further comprises a plurality of bulges, and each of the plurality of bulges is located between adjacent two recesses.

9. The earphone of claim 1, wherein the carbon nanotube structure comprises a plurality of carbon nanotubes substantially oriented along a first direction and parallel with the surface of the substrate.

10. The earphone of claim 9, wherein the plurality of recesses extends along a second direction, an angle is formed by the first direction and the second direction, and the angle is greater than 0 degrees and smaller than or equal to 90 degrees.

11. The earphone of claim 1, wherein the carbon nanotube structure comprises a carbon nanotube film, and the carbon nanotube film comprises a plurality of carbon nanotubes substantially extending along the same direction.

12. The earphone of claim 1, wherein the carbon nanotube structure comprises a plurality of carbon nanotube wires extending along the same direction, and the plurality of carbon nanotube wires is parallel with and spaced from each other.

13. The earphone of claim 12, wherein each of the plurality of carbon nanotube wires comprises a plurality of carbon nanotubes parallel with each other, and a distance between adjacent two carbon nanotube wires ranges from about 0.1 micrometers to about 200 micrometers.

14. The earphone of claim 12, wherein each of the plurality of carbon nanotube wires comprises a plurality of carbon nanotubes helically oriented around an axial of one of the plurality of carbon nanotube wires.

15. The earphone of claim 1, wherein the first speaker further comprises an integrated circuit chip on the second surface of the substrate, and the integrated circuit chip is integrated into the substrate and configured to apply audio signal into the sound wave generator.

16. The earphone of claim 15, wherein the integrated circuit chip are electrically connected to both the first speaker and the second speaker.

17. The earphone of claim 1, wherein the first speaker further comprises a heat-sink element on the second surface of the substrate.

18. The earphone of claim 1, wherein the first speaker and the second speaker are secured to the housing by a fastener.

19. The earphone of claim 1, wherein the second speaker is an electric loudspeaker, electromagnetic speaker, or capacitive speaker.

* * * * *